US007950175B1

(12) United States Patent
Kubusheski

(10) Patent No.: US 7,950,175 B1
(45) Date of Patent: May 31, 2011

(54) ATTACHABLE SINGLE FOLD DOUBLE WALL TRACK WITH SLIDING TAB

(76) Inventor: Kitty Kay Kubusheski, Lady Lake, FL (US)

( * ) Notice: Subject to any disclaimer, the term of this patent is extended or adjusted under 35 U.S.C. 154(b) by 110 days.

(21) Appl. No.: 12/462,758

(22) Filed: Aug. 10, 2009

(51) Int. Cl.

| | |
|---|---|
| ***G09F 23/10*** | (2006.01) |
| ***G09F 3/18*** | (2006.01) |
| ***G09F 3/20*** | (2006.01) |
| ***B42F 21/00*** | (2006.01) |
| ***B65D 27/00*** | (2006.01) |

(52) U.S. Cl. ..... 40/641; 40/359; 40/654.01; 40/661.08; 40/360; 283/36; 283/41; 229/67.1

(58) Field of Classification Search ..... 40/359, 40/654.01, 661.08, 360, 641; 283/36, 41; 229/67.1

See application file for complete search history.

(56) References Cited

U.S. PATENT DOCUMENTS 7,389,598 B2 * 6/2008 Bunger et al. ..... 40/359

* cited by examiner

*Primary Examiner* — Joanne Silbermann
*Assistant Examiner* — Syed A Islam
(74) *Attorney, Agent, or Firm* — Frank A. Lukasik

(57) ABSTRACT

A folded folder track with sliding tab either writable and/or channel tab which travels along the folded track area of the folder whereby the user can position the tab wherever it is needed along the top horizontal edge of the folder. This allows every tab in the filing system to be moved into a convenient, viewable position. Also, the user will be able to maintain the files in alpha numeric order without the tabs being hidden behind other tabs or without hiding other tabs which provides for quick and efficient retrieval of folders and the filing of folders. This folded folder track and writable tab will be of various lengths and colors to be of greater value for the user with multiple identification needs.

1 Claim, 7 Drawing Sheets

ATTACHABLE SINGLE FOLD DOUBLE WALL TRACK WITH SLIDING TAB

DESCRIPTION OF INVENTION

This attachable single fold double wall track with writable folded sliding tab is for the attachment to a file folder and many other types of media so as to create a tab which can be slid along the horizontal edge of the folder and be place anywhere it is needed in order for the tab to always remain visible and not hiding behind other tabs. It consists of two pieces; one, an attachable folded track which will be adhered to a folder via a permanent adhesive to a 1" portion of the track and along the whole length of 11½". The second piece is a sliding writable hook tab which is made to hook and interlock onto the folded track. There will be many sizes, styles and colors produced of the two separate pieces to be available for the diversity of filing needs. In preparation for attaching to a folder, if the file folder being used has a tab on it, then the tab should be cut off to create a straight edge along the top horizontal edge, then the protective peel of strip removed so the track can be adhered to the back portion of the file folder so that the sliding tab protrudes above the folder. This attachable track with sliding tab can be placed by the user onto all types of folders, hanging file folders, expandable accordion pockets, project keepers, document holders, manila envelopes, notebooks, composition folders, and even large 9"×12" envelopes and can transform into convenient, easily retrievable little packages ready to be alphabetically filed in a filing cabinet. Production materials could include plastics, vinyl, cardboard, laminate, or many other materials suitable for this type of application. Another embodiment of the sliding tab portion is a clear view channel tab to accept the insertion of pre printed labeling indicia. These products will be produced green to be a substantial help to our environment. All of the measurements mentioned are close approximations until such time as we can ascertain what the manufacturing capabilities will be. This attachable track will add no more than 1/32" to 1/16" to the width of a folder. The attachable nature of this invention is, in one instance, to be attached by the user to their filing media whether it's new or currently being used in their filing cabinets. The second attachable nature of this invention is that it could be attached to various filing media directly at the manufacturing stage by some type of heat sealing method or by gluing.

THE PURPOSE OF THIS INVENTION

The main purpose is to solve the universal hidden tab problem for all file users by providing an attachable track with a sliding tab which can be attached to any type of media and moved into any position along the top edge. Also, this invention will contribute to the cleaning up of our environment because it will decrease the number of file folders which are destined to be thrown out. People can get used to this new concept of sliding tabs by adding this invention to their existing file folders and they will never have to remake that particular file folder with a correct tab position again, because this invention will always give them the correct tab position. Another point is that when a file folder is heavily used on a daily basis, the portion that gets worn out first and damaged is the tab but with this invention and the use of the sliding channel tab it gives the user the economical choice to keep their old folder and of lengthening the usefulness of the old worn out tab because they can place it into the protective sliding channel tab. Transforming old folders into a sliding tabs folders will eliminate the waste of billions of folders being thrown into the land fills. At such a time when this attachable track with sliding tab is attached directly at the manufacturing stage to file folders, the consumer will be able to start their tiling cabinet with a totally adaptable and efficient filing system without the need to cut off tabs, remove peel-off strips and place on the folders. It will be a convenient ready made filing system which will save them the time and money usually wasted on hunting for hidden file folders and remaking the labels for all of the tabs in the wrong positions. These tabs will never need to be rewritten or replaced again.

THE PROBLEM WITH THE CURRENT SYSTEMS

One problem with the current system of filing folders and their tabs is that they always become hidden by other folders being added to the filing set and are not adaptable enough to the changing characteristics of a filing cabinet. Another problem that would arise is that of the domino effect on the whole filing system. When you place a new file in alphabetical order, with its fixed tab in a certain position, you displace all of the other tabs in the file set, thus requiring more file folders to be changed in order to keep the files in alphabetical order and to maintain the tabs in a viewable position. The next problem which is caused by the first two problems is that, in order be able to view all of the tabs without the necessity of thumbing through all of the hidden tabs lined up in back of one another, the user had to often times discard old file folders and then make new ones choosing a viewable tab position for the file folders. But then, as soon as another file name is added, the necessity of placing the file in alphabetical order may cause it to end up hidden again behind another tab. These old folders which have to be discarded in order to get a folder with a tab in a viewable position may have been well known to the user who might have had many hand written notes and pertinent information written down on the face of the folder or inside the cover as many users do. These hand written notes, dates, names, numbers, etc., could have been accumulated over a span of months and even years which need to be retained preferably in its original appearance and orientation on the folder. While copying those notes over onto a new file folder and labeling the new folder tabs would be the supposed necessary task, it does not maintain the orientation or the well know essence and appearance of those long used file folders plus it is very time consuming to transfer all of the information onto a new folder. From a monetarily economical and use of time stand point, the user would just resolve him/herself to the fact that they will just have to deal with hunting for and thumbing through the hidden tabs in their cabinet instead of trying to keep all folder tabs viewable by changing folders to get a tab in a viewable position. With these attachable sliding tabs the user can keep his old folder with all of its well known characteristics and create a new tab by attaching this attachable to the top of their folder. This attachable track with sliding tab eliminates all of the previously mentioned problems of the filing systems currently in use and makes the user's file folders to become convenient, viewable and totally adaptable to their continuously changing filing needs. Also, with the current systems there are too many folders which out of necessity are being thrown into our land fills. This invention will do its small part in helping our environment by limiting the number of and necessity of so many file folders being thrown out, replaced and relabeled. A folder could have two separate tracks attached which will have the capability for each of the tracks to independently allow a tab to slide across the top of the folder. With this feature, the user could then have the capacity to have two independently sliding tabs which could pass by each other and be placed anywhere along the top of the folder allowing for very industry specific filing needs to be satisfied. In various specific industries of the world there are unique filing needs and this particular need of a totally adaptable filing system has never been met before. The multiple combinations and uses for these types of double tracks are limitless. Each track would function independently of the other and would carry its own sliding tab and be placed on the following areas of the folders or other media: a track could be placed on the uppermost back portion of the back cover of a folder and on the uppermost portion of the front portion of the back cover thereby creating two independently functioning tracks attached onto one particular media of choice. Or the tracks could be placed on the front and back of the folder's front cover. This would allow for a wider array of identification indicia for each folder to carry along the track and for each tab to be positioned anywhere along the top of that particular media. These attachable folded tracks and folded tabs have a huge potential and greater capacity of diversity for solving many of the filing needs which are still unfulfilled in the world today. Multiple tabs and tracks on each folder could have multiple coding variables for specific industries with certain stop points along the track depending on the state of the file. These multiple tabs could be attached to the attachable track with sliding tab's in sizes ranging from very narrow lengths to longer lengths depending on the users needs. Color coding could be added to these tabs thereby increasing their problem solving potential for specific industries. Currently, the color coding in some systems is accomplished by the placing of colored stickers, on the folder which have to be re-applied to the tab when a variation of the file changes, but by having the capacity for multiple sliding tabs on each folder it would allow the user to move the colored notification tabs into another location along the top of the folder to show where it is in the progressive order or to show the state of the file or something industry specific which could show a multitude of needed notifications to the user. A whole new adaptable filing system could be produced by the attachment of this attachable track with sliding tab to file folders at the manufacturing stage. This would allow a user to start a whole new totally adaptable filing system from scratch at the beginning which will never have to be changed again.

DETAILED DESCRIPTION OF DRAWINGS

Figure 1:
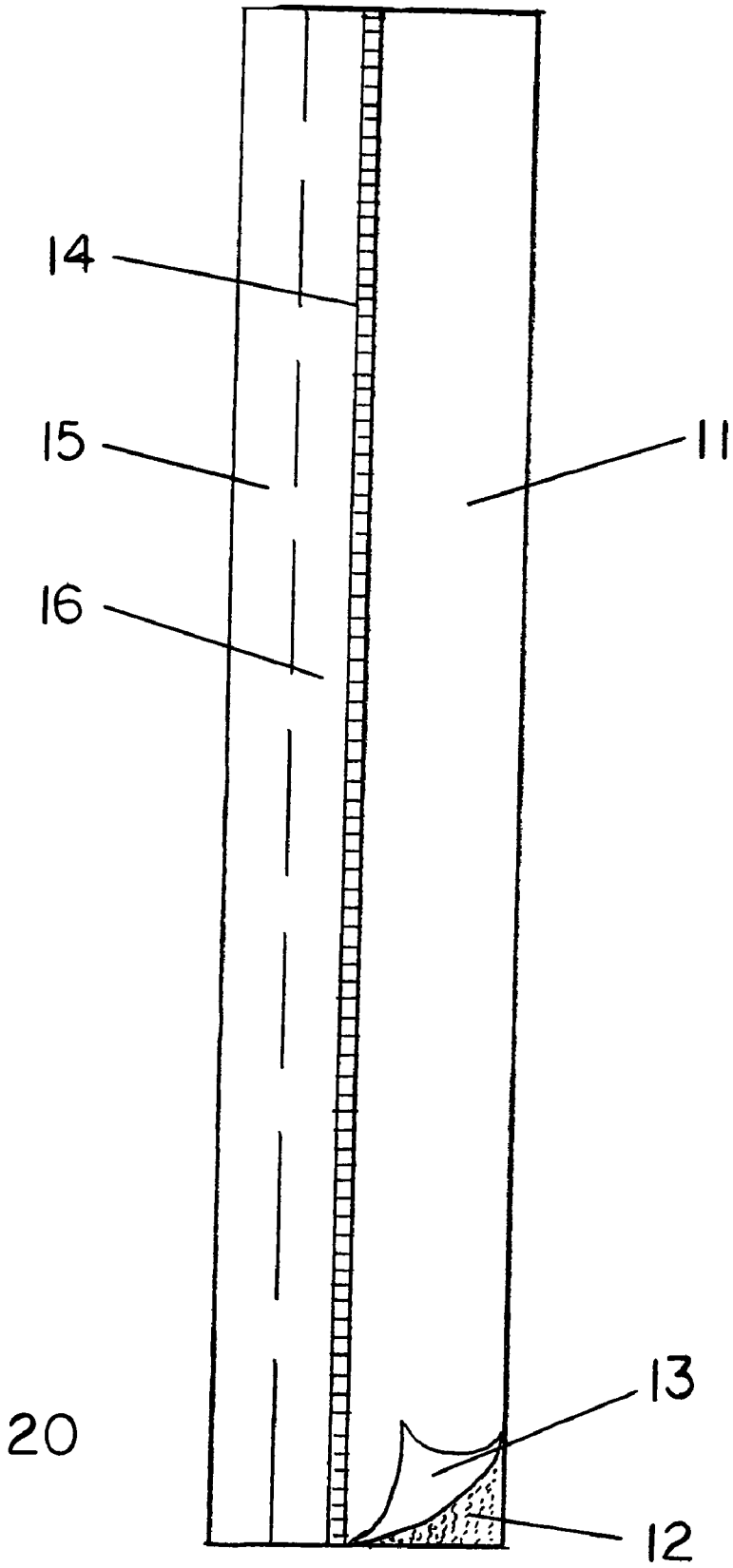
FIG. 1. Attachable single fold track opened up and flat
11 Self stick glued wall
12 Adhesive on self stick portion
13 Protective peel off strip
14 The track area
15 Hook wall portion
16 Flat wall portion
20 Fold line FIG. 2. Attachable single fold track ready for attachment to a generic folder
11 Self stick glued wall
12 Adhesive on self stick portion
13 Protective peel off strip
14 The track area
15 Hook wall portion
16 Flat wall portion
20 Fold line
26 Stoppers FIG. 3. Single fold track shown attached to a generic folder.
10*b* Back cover of generic folder
11 Self stick glued wall
15 Hook wall portion
16 Flat wall portion
26 Stoppers FIG. 4. Writable sliding tab to be inserted into the single fold track
17 Hook portion of sliding tab
18 Tab wall stem
19 Sliding tab identification area
20 Fold line FIG. 5 Single fold track and sliding tab attached to a generic folder.
10*a* Front cover of a generic folder
10*b* Back cover of generic folder
11 Self stick glued wall
15 Hook wall portion
16 Flat wall portion
17 Hook portion of sliding tab
18 Tab wall stem
19 Sliding tab identification area
26 Stoppers FIG. 6. Sliding Channel tab embodiment.
20*a*. First fold line
20*b*. Second fold line
21 Adhesive area
22. Front wall of channel tab
23 Back wall of channel tab
24*a* Back upper section of tab's stem wall has adhesive
24*b* Back lower section of tab's stem wall portion
25 Front hook portion of the sliding tab FIG. 7. View of sliding tab in its final orientation on a generic folder front view
10*a* Front folder cover
10*b* Back folder cover
19 Sliding tab front view
26 Stoppers

FIG. 1. This view shows the single fold track opened up in a flat position. To prepared the track to be attached to a folder, the hook wall 15 a ⅞" portion should be folded along fold line 20 and made to lie directly on top of section 16 a ⅞" portion not touching the track area 14 Track area 14 is a free and clear ⅛" portion where the sliding tab will transverse from side to side on the track. Self stick glued wall 11*a* 1" portion will be placed onto a generic folder after peeling off the protective peel off strip 13, revealing the self stick adhesive 12 underneath.

Figure 2:
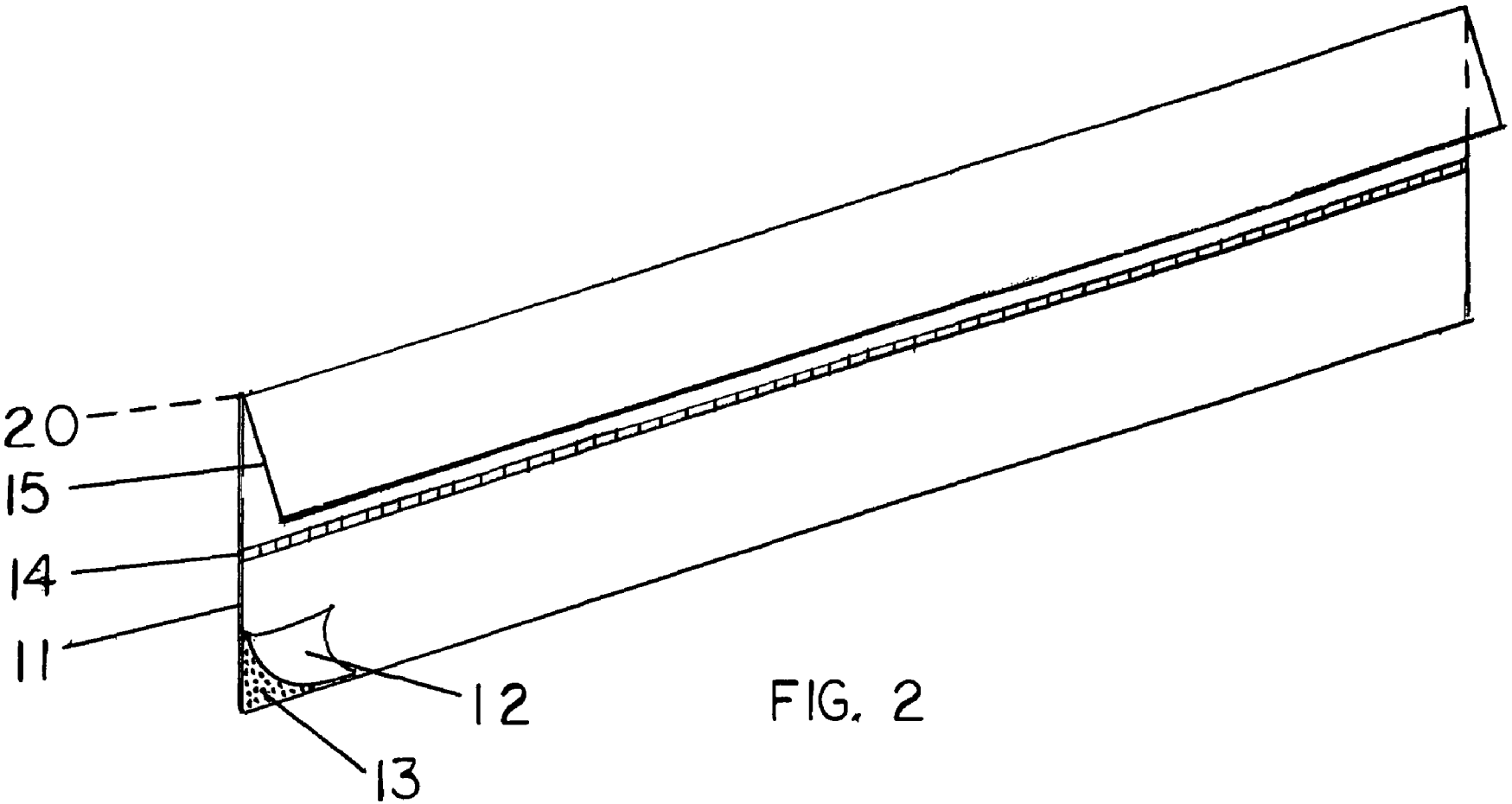

FIG. 2. This view shows the single fold track 11½" long by 2" wide folded and ready for attachment to a generic folder. The self stick glued wall 11 the 1" bottom most portion will be placed against a folder after the removal of the protective peel off strip 13, revealing the self stick adhesive 12 underneath. The track area 14 a ⅛" portion is to remain free and clear to allow the sliding tab to transverse along the length of the single fold track. The hook wall portion 15 a ⅞" portion should be folded along the fold line 20 and laid directly on top of flat wall portion 16 a ⅞" portion not interfering with clear track area 14. After the track and sliding tab is attached to a generic folder, both ends of portion 16 must be secured against the folder with a small piece of tape 26 thereby forcing portion 15 to be held tightly against the folder and keeping the inserted tab from sliding off the track.

Figure 3:
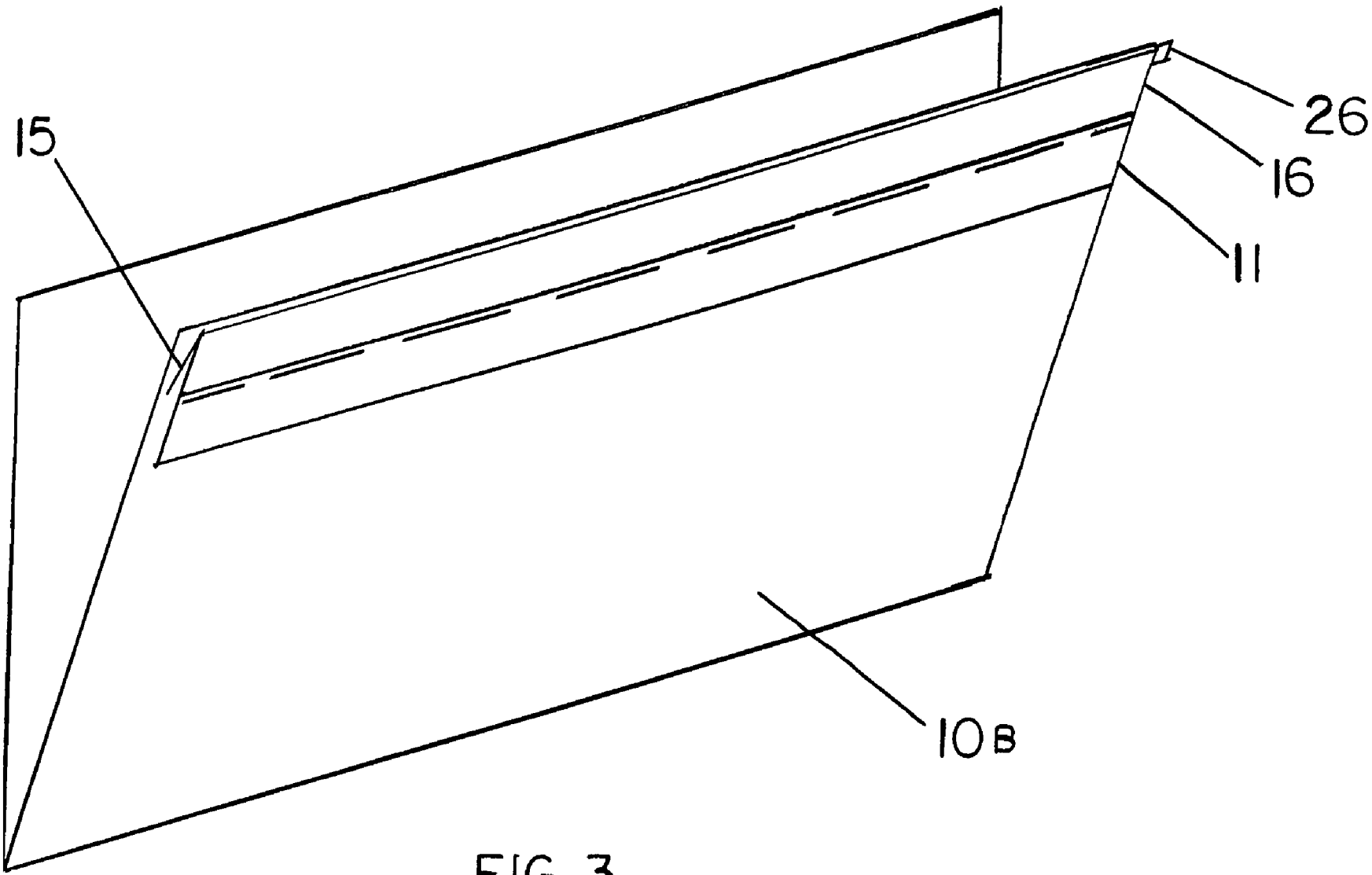
Figure 5:
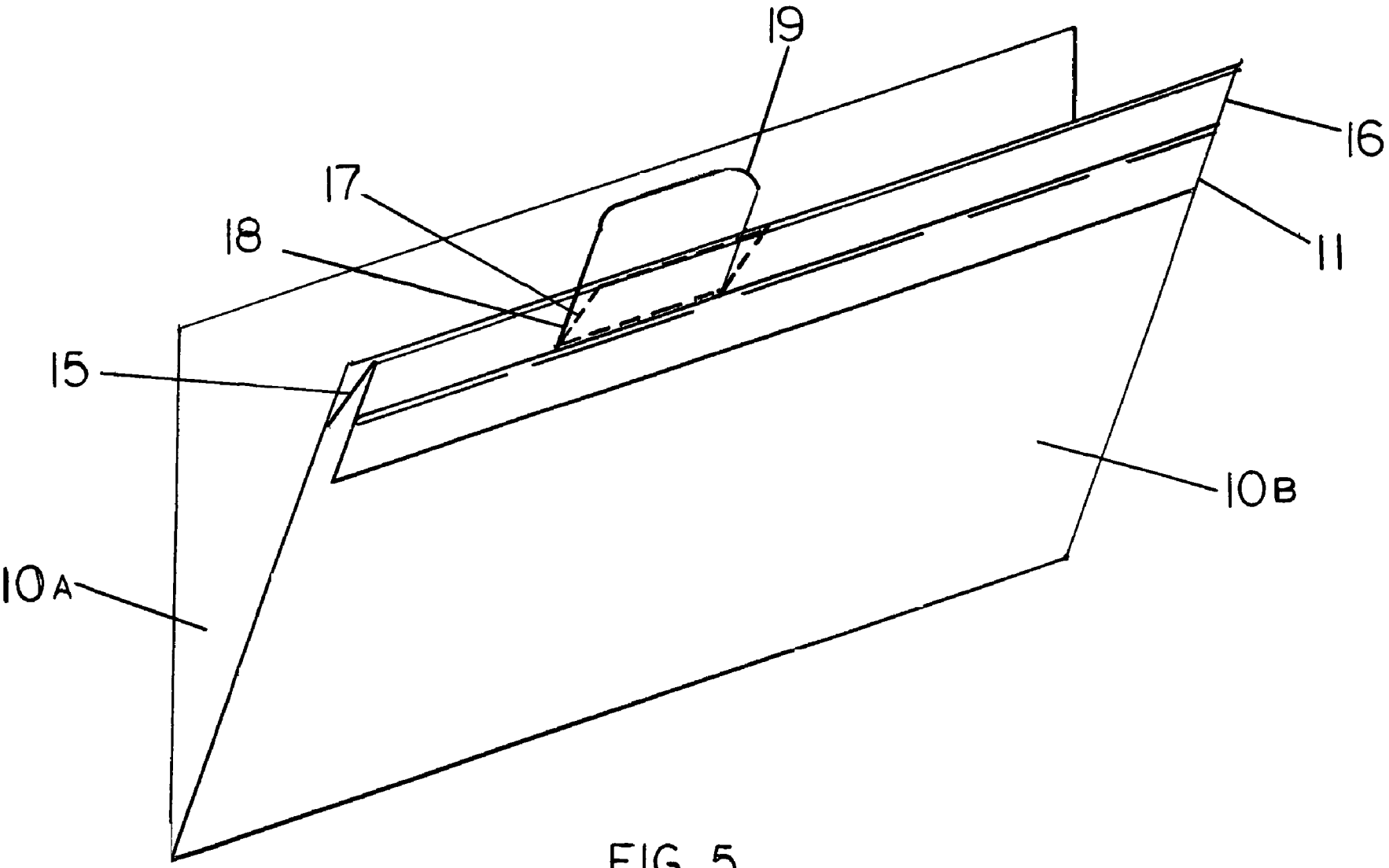

FIG. 3. This view shows the single fold track in FIG. 2, attached to a generic folder's back cover 10*b*. The self stick glued wall 11 a 1" portion has had the protective peel off strip removed and placed against the folder's back cover 10*b*. The hook wall portion 15 a ⅞" portion will lay flat against the top portion of the folder along the whole upper horizontal length. The flat wall portion 16 a ⅞" portion along with the folded hook wall portion 15 a ⅞" portion forms the sliding area for the sliding tab to be hooked onto as in FIG. 5 showing final orientation. Both ends of portion 16 must be secured against the folder with a small piece of tape 26 keeping the inserted tab from sliding off the track.

Figure 4:
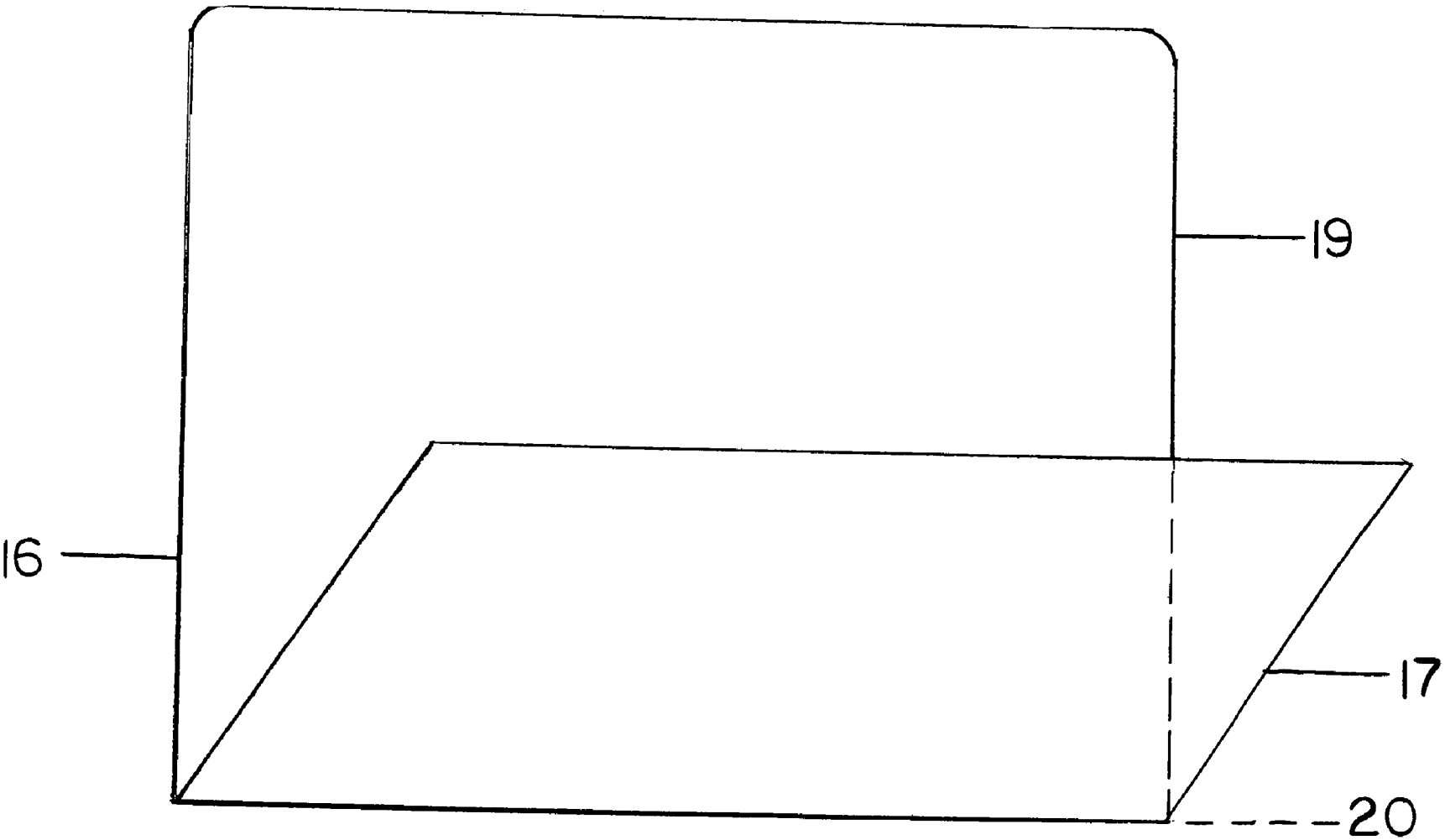

FIG. 4. This view shows the sliding tab's hook portion 17, a ⅞" portion partially folded up along the fold line 20. Hook portion 17 a ⅞" portion should be laid on top on section 18. This will leave the sliding tab identification area 19 to be able to protrude ⅞" above the top horizontal edge of the single fold track after is has been attached to a folder in its final orientation of use.

FIG. 5. This view shows the final orientation and use of the single fold track and sliding tab 19. The single fold track's self stick glued wall 11, is attached to a generic folder. The hook wall portion 15 will lay flat against the top portion of the folder along the whole upper horizontal length. The flat wall portion 16 along with the folded hook wall portion 15 forms the sliding area for the sliding tab 19 to be hooked into. The hook portion 17 of the sliding tab is interlinked into the hook wall portion 15 of the single fold track, thereby allowing the sliding tab to transverse along the whole top horizontal length of the generic folder 10*b*. Both ends of portion 16 must be secured against the folder with a small piece of tape 26 keeping the inserted tab from sliding off the track.

Figure 6:
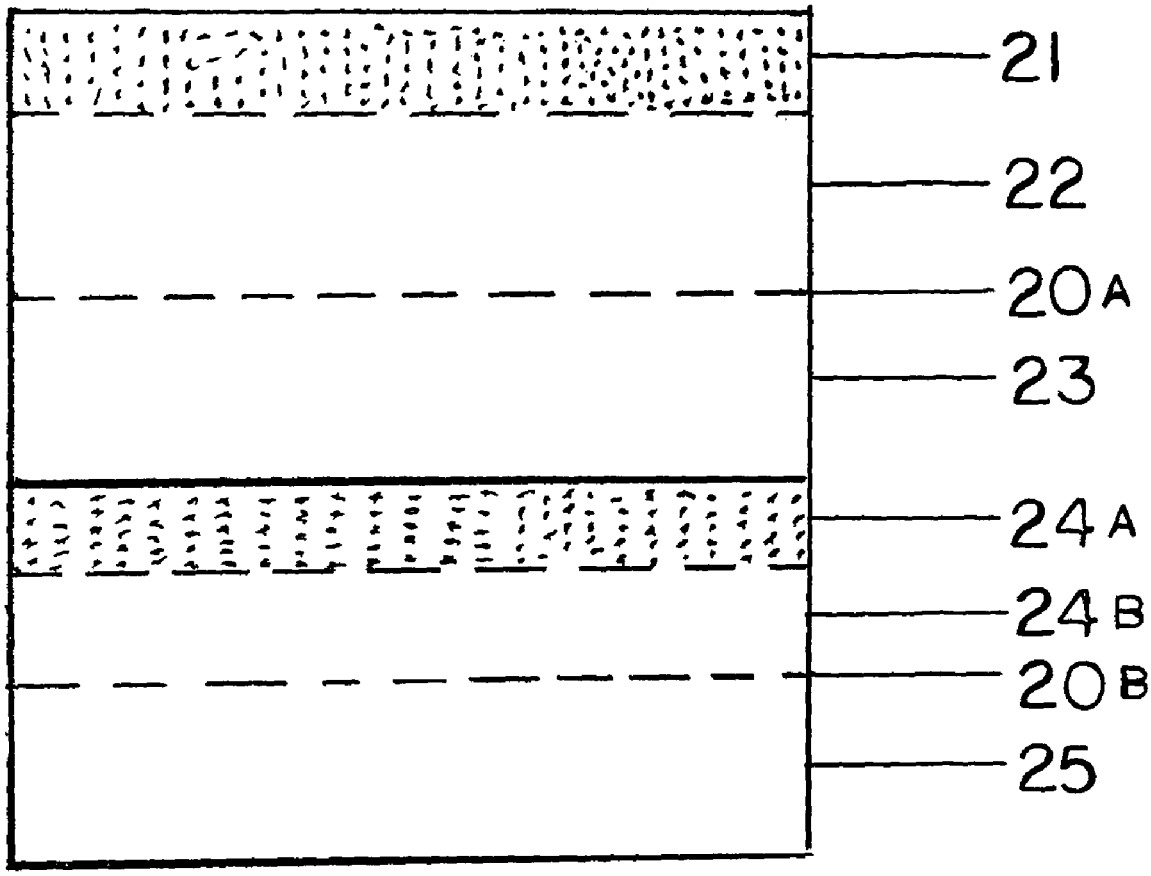

FIG. 6. This view shows the other embodiment of the sliding tab being a double walled channel tab which will allow for the insertion of a preprinted labeling indicia. To form the channel tab, the adhesive area 21 is folded along the first fold line 20*a*, and placed on top of the adhesive area 24*a*. This action creates the double walled channel tab consisting of the front wall of the channel tab 22, and the back wall of the channel tab 23. To form the hook in the tab to allow for it to interlock into the single fold track, the front hook portion of the sliding tab 25 should be folded upward along fold line 20*b*, and laid directly on top of 24*a* and 24*b*.

Figure 7:
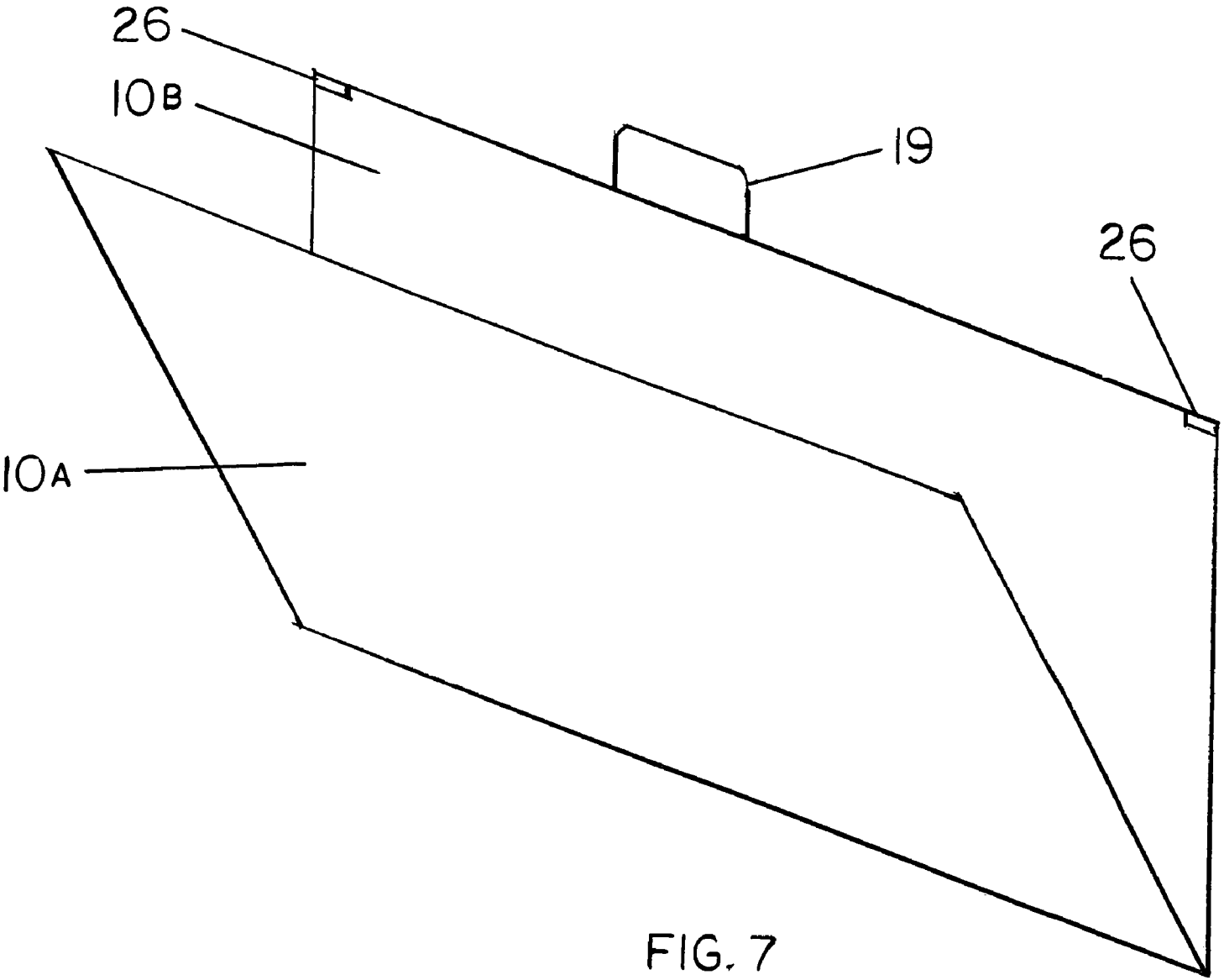

FIG. 7. This view shows a generic folder with a slightly opened front folder cover 10*a* and back folder cover 10*b* in the final orientation view of how the sliding tab 19 and track will look when it is attached to the back side of a generic folder's back folder cover 10*b*. The Stoppers 26 are showing as wrapped around the folder and pulling together the track and folder.

What is claimed is:

1. A sliding indexing label tab system for use with organizing a filing cabinet while eliminating the hidden folder tab problem, said label tab system comprising: a file folder having a top horizontal edge, an attachable, single folded track being adhered to a one inch portion of said top horizontal edge, along the entire length, said folded track having a permanent adhesive and having a protective peel off strip, a track area, a hook wall portion, a flat wall portion and a fold line, said hook wall portion being folded along a fold line and laid directly on top of said flat wall portion, a writable sliding tab being inserted into said folded track, said writable sliding tab having a first fold line and a second fold line, a first adhesive area and a second adhesive area, a front wall, and a back wall, said front wall being folded over and said first adhesive area contacting said second adhesive area thereby creating a double walled channel tab consisting of said front wall and said back wall and a hook portion, a tab wall stem, a hook portion being folded up along said second fold line of said sliding tab and being interlinked into said hook wall portion, thereby allowing the sliding tab to transverse along the whole top horizontal length of said folder, said flat wall portion being taped shut at each end thereby constricting the motion of said sliding tab.

* * * * *